US011262170B2

(12) United States Patent
Dennis

(10) Patent No.: US 11,262,170 B2
(45) Date of Patent: Mar. 1, 2022

(54) LIFELIKE IMAGE DART GAME

(71) Applicant: Frank Dennis, Warsaw, OH (US)

(72) Inventor: Frank Dennis, Warsaw, OH (US)

( * ) Notice: Subject to any disclaimer, the term of this patent is extended or adjusted under 35 U.S.C. 154(b) by 0 days.

(21) Appl. No.: 16/531,000

(22) Filed: Aug. 2, 2019

(65) Prior Publication Data

US 2020/0041237 A1 Feb. 6, 2020

Related U.S. Application Data

(60) Provisional application No. 62/714,495, filed on Aug. 3, 2018.

(51) Int. Cl.
*F41J 3/00* (2006.01)
*A63F 9/02* (2006.01)

(52) U.S. Cl.
CPC ..... *F41J 3/0071* (2013.01); *A63F 9/0208* (2013.01); *A63F 2009/0221* (2013.01)

(58) Field of Classification Search
CPC ..... F41J 3/0071; F41J 3/0061; F41J 3/0066; F41J 1/00; A63G 9/0208; A63G 2009/0221; A63G 9/0204; A63G 2009/0213; A63G 2009/0226; A63G 2009/023; A63G 2009/0234; A63G 2009/0239; A63F 9/0208; A63F 2009/0221; A63F 9/0204; A63F 2009/0213; A63F 2009/0226; A63F 2009/023; A63F 2009/0234; A63F 2009/0239
See application file for complete search history.

(56) References Cited

U.S. PATENT DOCUMENTS 2,210,149 A * 8/1940 Levine ..... F41J 3/008 273/403
3,300,216 A * 1/1967 Haecker ..... F41J 3/009 273/403
3,486,752 A * 12/1969 Colvin ..... F41J 1/00 273/378
3,697,073 A * 10/1972 Dooley ..... A63F 9/0208 273/358
4,203,600 A * 5/1980 Brown ..... F41J 1/00 273/407
4,257,613 A * 3/1981 Meyer Thor Straten ..... F42B 6/003 473/574
4,508,508 A * 4/1985 Theodore ..... F41J 1/00 273/409
2002/0113372 A1* 8/2002 Love ..... F41J 3/0004 273/408

(Continued)

*Primary Examiner* — Raleigh W Chiu
(74) *Attorney, Agent, or Firm* — Kathryn A. Perales

(57) ABSTRACT

The invention relates to dartboard games, where projectiles are thrown at a target. The face of the dartboard has a realistic, lifelike image of a game animal, and the higher scoring regions correlate to the kill zone of the game animal's anatomy. Lower scoring regions correlate to the rest of the body of the game animal, and penalty scoring regions may be present, scoring negative points. Players try to land their darts in certain scoring regions in order to score the most points, depending upon the rules of the game. Rules are provided for a 300 point and 21 point game. If the images are printed on the dartboard, the darts may be thrown or launched with an apparatus like a mini-bow or blow-gun. If the images are projected, the darts may be virtual.

1 Claim, 4 Drawing Sheets

(56) References Cited

U.S. PATENT DOCUMENTS

| | | | | |
|---|---|---|---|---|
| 2006/0257825 | A1* | 11/2006 | Jennings | F41J 1/00 434/16 |
| 2007/0046760 | A1* | 3/2007 | Zara | F41J 1/00 347/105 |
| 2007/0246887 | A1* | 10/2007 | Kagami | F41J 3/0042 273/371 |
| 2007/0262529 | A1* | 11/2007 | Gamez | F41J 5/205 273/409 |
| 2009/0058008 | A1* | 3/2009 | Baumgartner | B29C 51/10 273/408 |
| 2010/0207330 | A1* | 8/2010 | Yaroch | A63F 9/0278 273/358 |
| 2011/0254226 | A1* | 10/2011 | Sauerwine | F41J 3/02 273/317 |
| 2012/0200042 | A1* | 8/2012 | Kelly | A63F 9/0208 273/408 |
| 2013/0228975 | A1* | 9/2013 | Mason, III | F41J 1/10 273/406 |
| 2014/0151965 | A1* | 6/2014 | Garas | F41J 5/06 273/371 |
| 2015/0102564 | A1* | 4/2015 | Johnson | F41J 1/00 273/407 |
| 2016/0209184 | A1* | 7/2016 | Anderson | F41J 7/04 |
| 2016/0327369 | A1* | 11/2016 | Gratrix | F41J 1/10 |
| 2019/0137226 | A1* | 5/2019 | Howard | F41J 9/14 |
| 2019/0154410 | A1* | 5/2019 | Nelson | G02C 5/003 |
| 2019/0323804 | A1* | 10/2019 | Skinner | F41J 1/00 |
| 2019/0336872 | A1* | 11/2019 | Brown, Sr. | A63H 3/005 |
| 2020/0041237 | A1* | 2/2020 | Dennis | F41J 3/0071 |

* cited by examiner

LIFELIKE IMAGE DART GAME

BACKGROUND OF THE INVENTION

Traditional dart board games have existed for many years. The game usually is made up of a circular board, which is mounted upon a wall, and a plurality of darts, each of which has a sharp end which, when thrown, is supposed to stick in and cause the whole dart to stay stuck in the dart board until it is manually pulled out. The board is often made of a substance like sisal fibers, hemp fibers, bristle, cork or rolled paper, which darts can stick into over and over again, and be easily removed.

A traditional dart board has a small circle in the middle of its face, which circle is made of metal wire—this is the bullseye. A larger wire circle designates the outer limit of the area of the dartboard where a player can earn points. A plurality of wire spokes extend in a radial direction from the edge of the bullseye to the wire circle designating the limit of the scoring area, creating a plurality of minor sectors (excluding any area within the bullseye) of equal size. A dart board commonly has 20 or 12 of these sectors.

In the area between the outer circumference of the dart board and the circle designating the limit of the scoring area, numbers label each sector, to tell how many points a dart landing in that sector will score. The numbers are often also made of wire. A player stands a specified distance away from the dart board, and throws some number of darts at the board, one by one, trying to score points by causing the darts to stick in the bullseye area or in the sectors.

Most dart boards have a color scheme where the bullseye is a first color, and the sectors alternate in a second and a third color, so that it is easy to see the boundaries between the various zones of the dart board.

Recently, it has become possible to order a dart board with any image on its face, instead of a sector pattern. Usually the metal wires designating the sectors, bullseye and point values are still present, for scoring purposes.

BRIEF SUMMARY OF THE INVENTION

The invention is a new type of dart game, which relies upon a realistic, lifelike image with markings on the face of the dart board for scoring, rather than sectors. It is designed to appeal to hunters, and often depicts a game animal.

The image on the face of the dart board includes a small circle in the ideal kill zone for that animal, which serves as the bullseye, and the most points for a hit, for example, 10. A larger concentric circle surrounds the bullseye, and a dart sticking in the area inside of the larger circle but outside of the bullseye scores a lesser amount of points, for example, 8. Any dart which lands outside of the larger circle but inside of the body of the pictured animal scores a lesser amount of points, for example, 5. No score is earned if the dart sticks outside of the body of the pictured animal.

The game can be played with different sets of rules, as to how many darts are thrown in each round, and how many rounds, and the object of the game.

DETAILED DESCRIPTION OF THE INVENTION

The invention is a game which includes a dart board with a realistic, lifelike image on its face, and a plurality of darts. A player scores points by throwing and causing a dart to stick in one of the scoring regions of the image on the dart board.

The face of the dart board may be circular, or of any shape.

Figure 1:
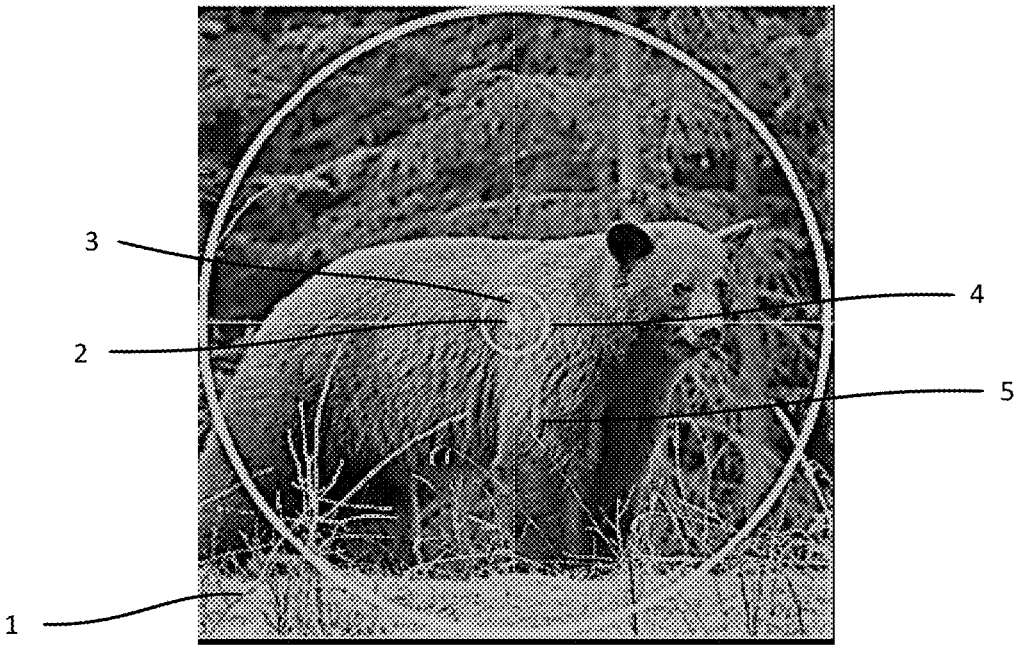
FIG. 1 is a front view of a dart board with a game animal and concentric circles to represent the scoring regions.
Figure 2:
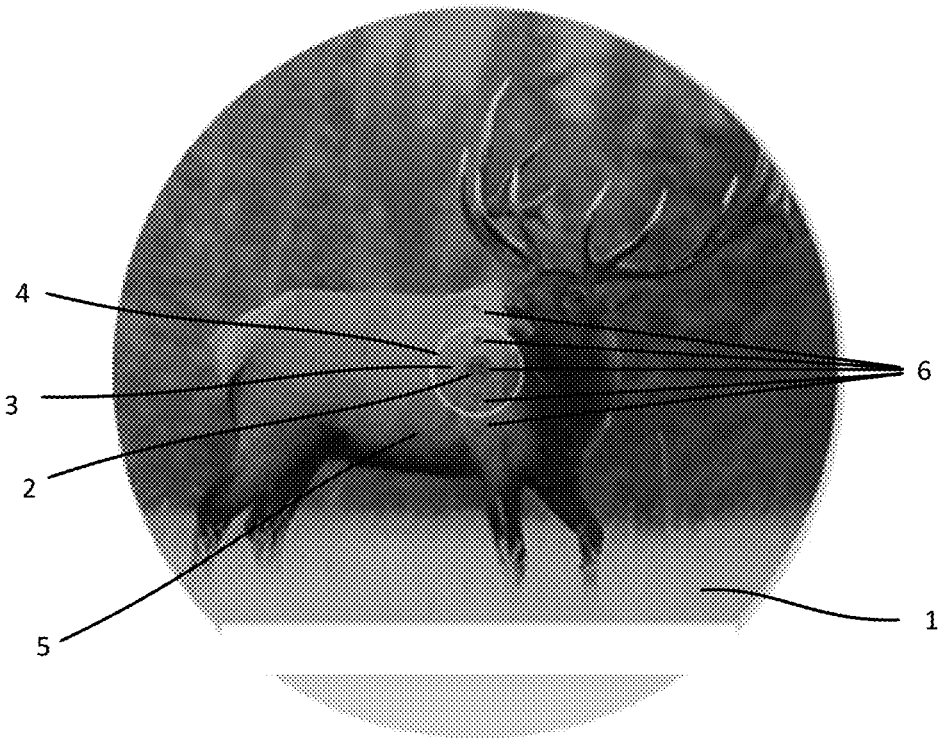
FIG. 2 is a front view of a dart board with a game animal and concentric circles, with the addition of numbers placed in the scoring regions to show the number of points scored when hitting each region.

In one embodiment, shown in FIG. 1, the image shown on the dart board 1 is a game animal such as an elk or a bear. A small circle 2 is printed or otherwise placed or shown upon the area of the animal where the heart is located, representing the first scoring region. A larger concentric circle 4 surrounds the first circle 2. The area 3 inside of the larger circle 4, but not including the area inside of the small circle 2, is the second scoring region. The remainder of the body 5 of the pictured animal, not including the first and second scoring regions, is the third scoring region. As shown in FIG. 2, the three scoring regions may have numbers 6 printed on them, representing the number of points scored when a dart sticks in the region. Depending upon the placement of the image, the first scoring region may be in the center of the dart board, like a traditional bullseye, or it may be located elsewhere on the dart board 1.

Figure 3:
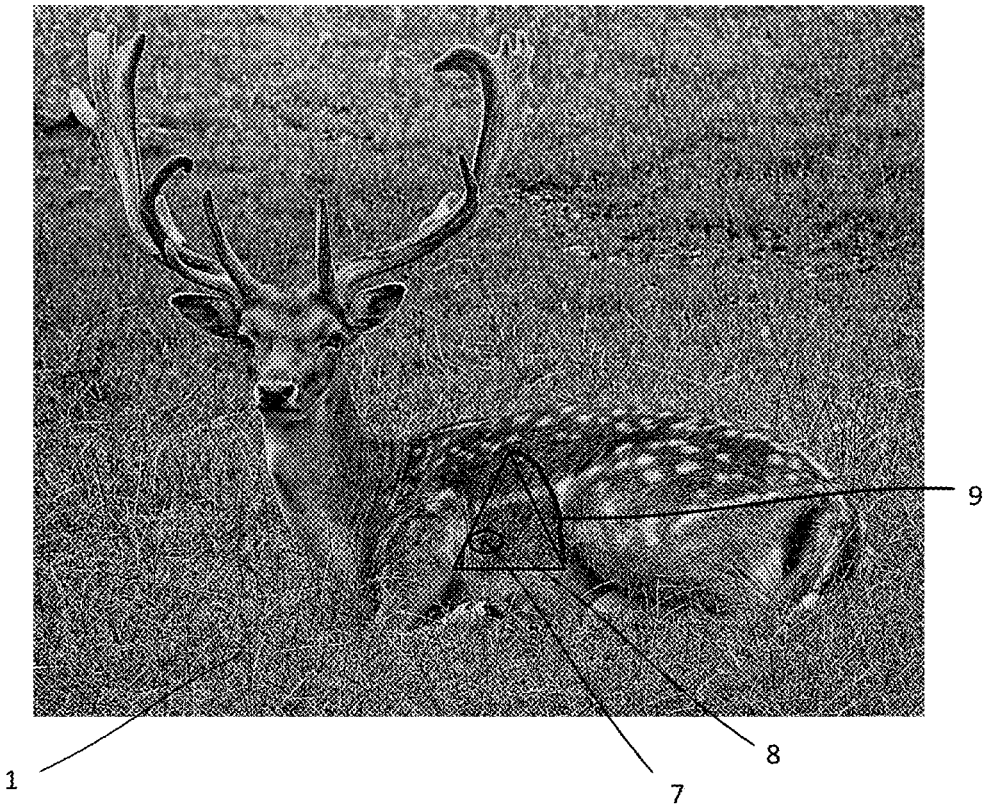
FIG. 3 is a front view of a dart board with a game animal and outlines of the animal's heart, lungs and liver to represent the scoring regions.

In a second embodiment, shown in FIG. 3, the image on the dart board 1 is also a game animal. Instead of concentric circles, the first region is a drawing or image of the animal's heart 7, in an accurate location. The second region is a drawing or image of the animal's lungs 8, which in a deer surrounds the first region. The third region is a drawing or image of the animal's liver 9, which in a deer is located next to the lungs, in the direction of the hindquarters. If the pictured animal is not a deer, the three regions may look different, but will be accurately depicted, in an accurate location based upon the image.

In either embodiment, a plurality of game animals may be pictured in the single image, each animal with its own three regions for scoring purposes. Alternatively, the image may be of something other than a game animal, with the scoring regions located in appropriate locations for the given image.

Penalty regions may be present on the image, where a dart scores a negative number of points.

To play a 300 point game, a player has three darts which are thrown in ten rounds. The first region scores 10 points; the second region 8 points; the third region 5 points; and a hit in any other area of the dart board scores 0 points. For each round, the maximum score is 30 points, if all three darts stick in the first region. The minimum score for each round could be negative, depending upon whether penalty regions are present, and how many points are deducted for a hit in each penalty region. A player may play all ten rounds with the same image, or the player may change the image on the dart board each round, or may change the image less often during the game.

To play a 21 point game, players take turns throwing darts, trying to hit the first, second and third regions. A hit to each region scores one point, to a maximum of 7 points per region. The first player to hit each region at least 7 times scores 21 points and wins.

The dart board may be made of any traditional or novel substance, including but not limited to sisal fiber, bristle, hemp fiber, cork or paper, so long as the hits the darts make can be easily recorded. Usually this means that the sharp end of the dart sticks into the substance of the dart board. It could also be an electronic dart board with soft tip darts that stick into small holes in the board, which can be made of nylon, plastic, e-bristle or other substances.

Darts or similar projectiles may be thrown at the target by hand, or launched with an assisting device, such as a pistol, blowgun, or a mini-bow.

The image shown on the face of the dart board may be directly printed upon the dart board, or it may be printed upon a piece of paper or other substance which is fastened to the face of the dart board, or it may be projected so that it shows on the face of the dart board with any type of image projector, or other methods may be used. The image should be realistic and lifelike. If the image is projected, then it may move during the game.

If the dart board is electronic with scoring capability, then it may be programmed to record the scores, even if the image and scoring regions move. The dart board may also be implemented on a motion sensing type of game console, such as Wii, Kinect or Playstation Move. In this version, the darts would probably not stick to the image, or the darts may be virtual, but hits would be recorded by the hardware and software for scoring purposes.

Figure 4:
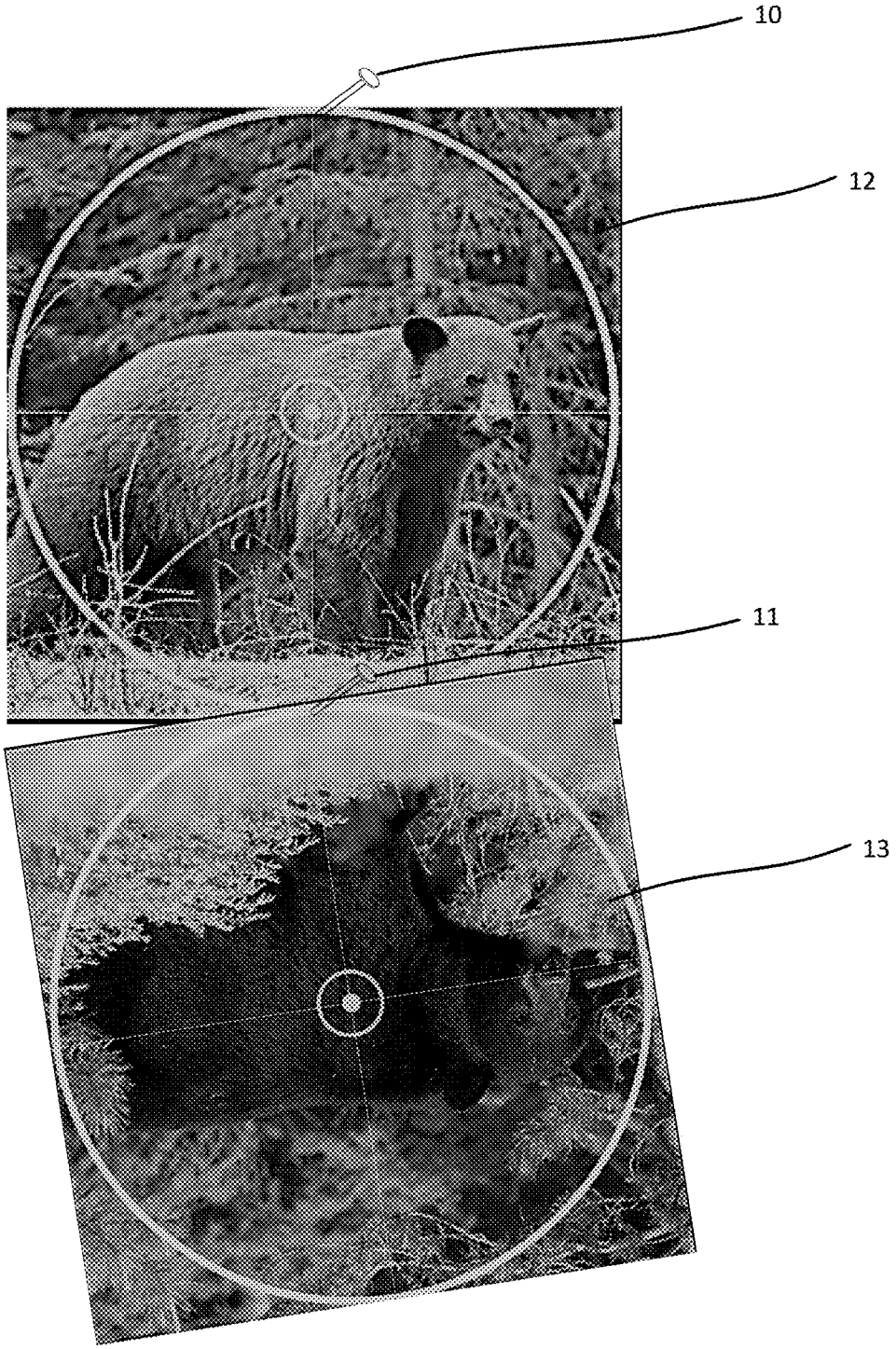
FIG. 4 is a front view of a dart board with one target showing on the dart board, and another target which has swiveled down out of the way.
Figure 5:
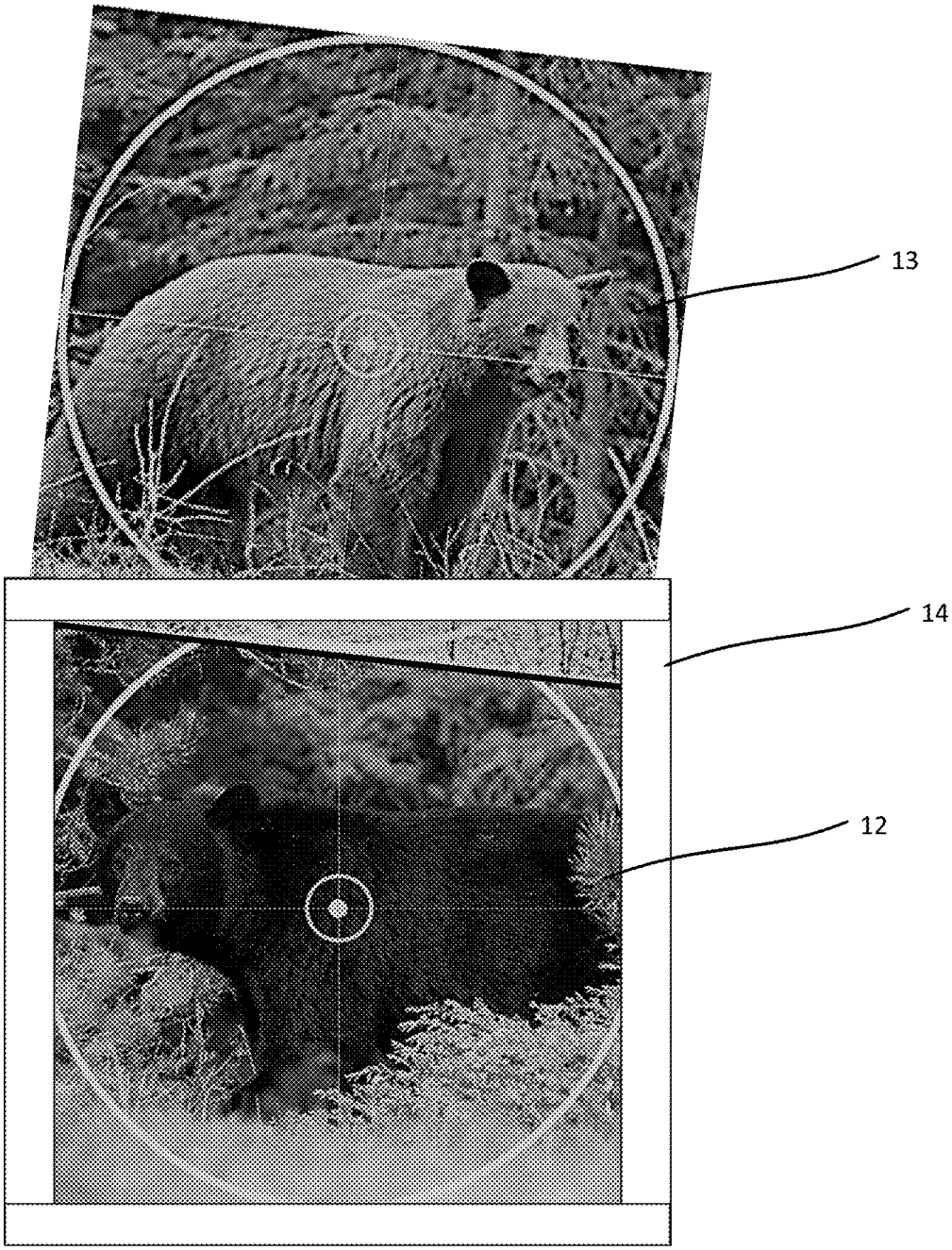
FIG. 5 is a front view of a dart board with a frame, where a used target is being pulled up out of the frame to reveal a new target.

In one embodiment, shown in FIG. 4, printed targets made of paper or another thin material are placed upon the dart board with fasteners, such as a clip or pin 10 on top and a pin 11 on the bottom of the dart board. When a player finishes one round of the 300 point game, the player can remove or open the top fastener, allow the top printed used target 13 to rotate or swivel on the bottom fastener downwards and out of the way to reveal another printed target 12 with a different image, and replace the top fastener. Then the player plays the next round with the new uncovered image 12 (which was underneath the first image) showing. Five doublesided printed targets may be attached to the dart board, so that ten different targets with different images are available for a 300 point game. After the fifth round, the player unfastens both the top and bottom fasteners, removes the five targets in a stack, turns them all over, and re-fastens the stack of printed targets to the dart board, making five targets with new images available.

In another embodiment, paper targets may be held onto the face of the dart board with a frame 14. After each round, the used target 13 may be removed from the frame, revealing another target 12 with a new image underneath, or a new target may be placed into the frame.

The invention claimed is:

1. A dart board game kit comprising:

a target with a front surface, said front target surface having a realistic, lifelike image of one or more game animals; one or more bullseye areas at the location of each game animal's heart, indicated by a small circle or other shape, defining a heart scoring region; a larger circle or other shape surrounding each heart scoring region at a distance, enclosing a second scoring region; and the remainder of the game animal defining a body scoring region;

a plurality of darts removably engageable with said front target surface; and a set of playing rules informing players how to play the game, each player being required to stand a predetermined distance from said target when throwing said projectiles; and each player attempting to score points by throwing said darts to score hits in said scoring regions, wherein the heart scoring region is worth the largest amount of points, the second scoring region is worth a lesser amount of points, the body scoring region is worth an amount of points less than the second scoring region, and any hit landing outside of the defined scoring regions is worth zero points;

wherein a plurality of sheets depicting different images of game animals with scoring regions are removably attached to said front target surface in a stack of sheets, with a top fastener holding the stack of sheets, and a bottom fastener comprising a pin or nail, and wherein the sheet in the front of the stack may be easily moved or removed so as to expose the next sheet beneath said front sheet, by releasing the front sheet from the top fastener, so that said front sheet remains fastened to the bottom fastener, and rotates down around the bottom fastener and out of the way of the next sheet in the stack.

* * * * *